US007249835B2

(12) United States Patent
Hoshino et al.

(10) Patent No.: US 7,249,835 B2
(45) **Date of Patent: *Jul. 31, 2007**

(54) INK JET RECORDING APPARATUS

(75) Inventors: Yoshihide Hoshino, Hachioji (JP); Tsutomu Yoneyama, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 283 days.

This patent is subject to a terminal disclaimer.

(21) Appl. No.: 10/724,846

(22) Filed: Dec. 1, 2003

(65) Prior Publication Data

US 2004/0119772 A1 Jun. 24, 2004

(30) Foreign Application Priority Data

Dec. 2, 2002 (JP) ..... 2002-349637
Dec. 11, 2002 (JP) ..... 2002-359316

(51) Int. Cl.
*B41J 2/01* (2006.01)

(52) U.S. Cl. ..... 347/102; 347/103

(58) Field of Classification Search ..... 347/102
See application file for complete search history.

(56) References Cited

U.S. PATENT DOCUMENTS 5,486,856 A 1/1996 Katsuma et al.
5,896,154 A * 4/1999 Mitani et al. ..... 347/102
6,350,071 B1 2/2002 Conwell et al.
2001/0052920 A1 12/2001 Matsumoto et al.
2002/0149660 A1 10/2002 Cleary et al.
2004/0080598 A1* 4/2004 Hasebe et al. ..... 347/102
2005/0018026 A1* 1/2005 Nerad et al. ..... 347/102

OTHER PUBLICATIONS

European Search Report for Application No. 03257517.7-2304-dated Apr. 19, 2004.

* cited by examiner

*Primary Examiner*—Stephen Meier
*Assistant Examiner*—Ly T. Tran
(74) *Attorney, Agent, or Firm*—Cantor Colburn LLP

(57) ABSTRACT

An ink jet recording apparatus having: a recording head of ink jet type for jetting ink from a plurality of jet openings; a light source for emitting light to cure an ink jetted from the recording head and adhered to a recording medium; a light quantity measuring section for measuring a light quantity of the light source; and a control section for controlling the light quantity of the light source according to a measured value by the light quantity measuring section.

35 Claims, 11 Drawing Sheets

INK JET RECORDING APPARATUS

BACKGROUND OF THE INVENTION

1. Field of the Invention

The present invention relates to an ink jet recording apparatus in which photo-curable ink is used.

2. Description of the Related Art

Generally, in an ink jet recording apparatus, noise during printing is relatively small and the print quality is good, so that it has been widely used.

The ink jet recording apparatus jets fine ink droplets from nozzles of the recording head toward a recording medium such as a paper by using, for example, piezoelectric elements, heater elements or the like, and moves a relative position of the recording head and the recording medium while making ink penetrate the recording medium or fixing ink on the recording medium so as to form an image on the recording medium.

There are, for example, a serial head type and a line head type ink jet recording apparatuses. In the serial head type, a recording head reciprocates on the recording medium and the recording medium is carried in a direction perpendicular to a scanning direction of the recording head for forming an image. In the line head type, a recording head which has a nozzle line having a recording range width for the recording medium is fixed, and an image is formed by carrying the recording medium perpendicular to a width direction of the recording medium.

Recently, in a field of printing on goods or packing material for goods, demand for a small-lot production have been increasing, so that the ink jet method in which a small-lot production can be achieved at low cost in comparison with the method such as a gravure printing method or a flexographic method which needs a plate making has been used.

As is well known, material with less ink absorptivity such as resin or metal is hardly used for goods or packing material for goods.

For enabling the ink to be fixed on the recording medium when such the material with less absoptivity is used as a recording medium, an ink jet recording apparatus of photo curable type in which the photo curable ink with high viscosity is irradiated with light such as ultraviolet-rays (UV-rays) after the ink was jetted and attached to the recording medium to cure and fix the ink on the recording medium has been developed.

Earlier, as the ink jet recording apparatus of the photo curable type, an ink jet recording apparatus of an ultraviolet curable type has been put to practical use, in which radical polymerization ink is used and a great deal of UV-rays is radiated all at once. As a light source, it has been proposed to use a light source which radiates light with directivity such as laser beam or the like (see, for example, Japanese Patent Laid-Open Publication No. 2001-310454 (P.4)). Specifically, as the light source which radiates light with directivity, a semiconductor laser, a light emitting diode or the like is well known.

By using a semiconductor laser or a light emitting diode, a calorific value during irradiation becomes small, so that electric power consumption is lowered. In addition, a light source unit becomes small in comparison with a fluorescent lamp or a high pressure mercury lamp. Moreover, a semiconductor laser or a light emitting diode is good in stability and easy to adjust light quantity.

However, there has been a following problem in the earlier developed technique.

When radical polymerization ink is used, relatively a great deal of UV irradiation is required. Thus, a high-power light source is to be mounted, thereby causing the apparatus to become large and raise the cost of production.

To solve the problem, it is considered to use cationic polymerization ink which has not been put to practical use. However, cationic polymerization ink has a unstable property such as a humidity dependency and a property to cause curing reaction with weak light such as reflection light or the like, so that it is hard to handle and difficult to put into practical use.

For example, degradation of a light source by long-term use lowers lighting intensity to the ink, and decline of lighting intensity is caused by ink mist as the light source gets closer to the recording head by request of miniaturizing the apparatus and the like. Under the circumstances, when the cationic polymerization ink with the above described properties is used, curing failure is likely to occur and it does not reach the stage of practical use.

Especially, when a plurality of light sources are used with respect to each recording head, the lighting intensity which is required for curing reaction is ensured by the plurality of light sources. However, when even only one of the light sources is degraded or affected by the ink mist to lower the light quantity, the lighting intensity which is required for curing reaction cannot be ensured. When the light quantity of a light source is lowered, maintenance is needed to be performed. However, when the plurality of light sources are used as described above, the timings of lowering the light quantity in each light source differ, so that number of maintenances are increased to increase the burden on workers.

SUMMARY OF THE INVENTION

The present invention has been developed in view of the above described earlier developed technique, and in an ink jet recording apparatus in which photo curable ink is used, an object of the present invention is to improve reliability of the apparatus by preventing printing failure by curing failure for enabling ink with high curing sensitivity which is cured by a relatively low-power light source to put into practical use, thereby miniaturizing the apparatus and reducing the cost for production.

Another object of the present invention is to decrease the burden on workers by decreasing number of maintenance.

In the first aspect of the invention, the ink jet recording apparatus comprises:

a recording head of ink jet type for jetting ink from a plurality of jet openings;

a light source for emitting light to cure an ink jetted from the recording head and adhered to a recording medium;

a light quantity measuring section for measuring a light quantity of the light source; and a control section for controlling the light quantity of the light source according to a measured value by the light quantity measuring section.

According to the first aspect of the present invention, a light quantity of a light source can be measured, so that it is possible to pre-detect whether the light quantity which is needed for ink curing is given to the ink on the recording medium. Thus, a light quantity of a light source can be controlled with high accuracy. Accordingly, reliability of the ink jet recording apparatus can be improved.

Since a light quantity of a light source can be controlled with high accuracy, the ink with high curing sensitivity which is cured by a relatively low-power light source such as cationic polymerization ink can be put into practical use. Accordingly, since a light source with high-power is not required, the light source device can be small. Therefore, the ink jet recording apparatus can be small and the cost for production can be reduced.

Preferably, the ink jet recording apparatus comprises a light source scanning section for scanning the light source above the recording medium by moving the light source in a direction perpendicular to a carrying direction of the recording medium, and a plurality of light sources disposed at different positions seen from the direction perpendicular to the carrying direction of the recording medium, the plurality of light sources being moved in order in a measuring region for the light measuring section to make the light quantity measuring section measure a light quantity of each of the plurality of light sources in order.

Preferably, the ink jet recording apparatus comprises a recording head scanning section for scanning the recording head above the recording medium by moving the recording head in the direction perpendicular to the carrying direction of the recording medium, wherein the light source scanning section is formed to move the light sources together with the ink jet head by the recording head scanning section.

Preferably, the ink jet recording apparatus comprises a plurality of light sources and a scanning section, the scanning section moving the light quantity measuring section to measure a light quantity of each of the plurality of light sources in order by the light quantity measuring section.

Preferably, the ink jet recording apparatus comprises a plurality of light sources at different positions seen from a carrying direction of the recording medium and a scanning section, the scanning section moving the light quantity measuring section in the carrying direction of the recording medium to measure a light quantity of each of the plurality of light sources in order by the light quantity measuring section.

Preferably, the ink jet recording apparatus comprises a recording medium supporting section for supporting the recording medium disposed between the light source and the light quantity measuring section, wherein at least a portion of the recording medium supporting section comprises a member which makes at least a portion of light of the light source pass therethrough.

Preferably, the ink jet recording apparatus comprises a storage section for storing a desired value of a light quantity controlled by the control section, and a display section for informing a measured result to a user when a measured value measured by the light quantity measuring section is less than the desired value.

Preferably, the ink jet recording apparatus comprises a storage section for storing a desired value of a light quantity controlled by the control section, wherein a recording operation by the recording head is banned when a measured value measured by the light quantity measuring section is less than the desired value.

Preferably, a light quantity of is measured by the light quantity measuring section every scanning.

Preferably, a light quantity is measured by the light quantity measuring section when recording on the recording medium is started or finished.

Preferably, a light quantity is measured by the light quantity measuring section when the ink jet recording apparatus is operating or on standby.

Preferably, a light quantity is measured by the light quantity measuring section according to a preset operating time of the ink jet recording apparatus or an elapsed time after the ink jet recording apparatus was activated.

Preferably, the light source is any one of a mercury lamp, a metal halide lamp, a semiconductor laser and a light emitting diode.

Preferably, the ink is cured by an ultraviolet-ray.

Preferably, the ink comprises a cationic polymerization ink.

In the second aspect of the invention, the ink jet recording apparatus comprises:

a recording head on which a plurality of jet openings are arranged in line for jetting photo-curable ink from the jet openings on a recording medium;

a plurality of light sources for irradiating an ink jetted from the recording head with light to cure the ink;

a light quantity measuring section for measuring a light quantity of each of the plurality of light sources;

a storage section for storing a desired value of each of the plurality of light sources; and a control section for controlling the light quantity of each of the plurality of light sources according to measured values by the light quantity measuring section and desired values stored in the storage section, when a measured value of a first light source is less than a desired value of the first light source, the control section increasing a light quantity of a second light source which is different from the first light source.

According to the second aspect of the present invention, even when a light quantity of a light source (first light source) decreases by degradation, ink mist or the like, the decrease of light quantity is supplemented by another light source (second light source), so that the lighting intensity enough to cause ink curing reaction can be achieved. When a light source having a light quantity less than the desired value thereof in other light sources appears while carrying out image formation, the lighting intensity enough to cause ink curing reaction can be achieved by increasing a light quantity of a light source in the remaining light sources again. When the lighting intensity enough to cause ink curing reaction cannot be achieved because the number of light sources having a light quantity less than the desired value thereof increases, workers carry out maintenance such as removing the ink which is the cause of the decrease of light intensity or exchanging the degraded light source. The number of maintenances can be decreased by adjusting the timing of each maintenance, thereby reducing the load on workers.

Preferably, the ink jet recording apparatus comprises a light source scanning section for scanning the light source above the recording medium by moving the light source in a direction perpendicular to a carrying direction of the recording medium, wherein the plurality of light sources are disposed at different positions seen from the direction perpendicular to the carrying direction of the recording medium, and the plurality of light sources are moved in order in a measuring region for the light measuring section to make the light quantity measuring section measure a light quantity of each of the plurality of light sources in order.

Preferably, the ink jet recording apparatus comprises a recording head scanning section for scanning the recording head above the recording medium by moving the recording head in the direction perpendicular to the carrying direction of the recording medium, wherein the light source scanning section is formed to move the plurality of light sources together with the ink jet head by the recording head scanning section.

Preferably, the ink jet recording apparatus comprises a scanning section for moving the light quantity measuring section to measure a light quantity of each of the plurality of light sources in order by the light quantity measuring section.

Preferably, the ink jet recording apparatus comprises a scanning section, wherein the plurality of light sources are disposed at different positions seen from a carrying direction of the recording medium, and the scanning section moves the light quantity measuring section in the carrying direction of the recording medium to measure a light quantity of each of the plurality of light sources in order by the light quantity measuring section.

Preferably, the ink jet recording apparatus comprises a recording medium supporting section for supporting the recording medium disposed between the light source and the light quantity measuring section, wherein at least a portion of the recording medium supporting section comprises a member which makes at least a portion of light of the light source pass therethrough.

Preferably, the ink jet recording apparatus comprises a display section for informing a measured result to a user when a measured value measured by the light quantity measuring section is less than the desired value.

Preferably, the control section increases a light quantity of a light source which is proximity to the first light source.

Preferably a light source which is proximity to the first light source irradiates a surface of the recording medium with light having a light quantity not less than a light quantity in case that the first light source irradiating with light having a desired light quantity.

Preferably an irradiated light quantity of a light source which is proximity to the first light source is determined according to a profile of the light source which is proximity to the first light source.

Preferably, a recording operation by the recording head is banned when a measured value measured by the light quantity measuring section is less than the desired value.

Preferably, a light quantity is measured by the light quantity measuring section every scanning.

Preferably, a light quantity is measured by the light quantity measuring section when recording on the recording medium is started or finished.

Preferably, a light quantity is measured by the light quantity measuring section when the ink jet recording apparatus is operating or on standby.

Preferably, a light quantity of a light source is measured by the light quantity measuring section according to a preset operating time of the ink jet recording apparatus or an elapsed time after the ink jet recording apparatus was activated.

Preferably, the light source is any one of a mercury lamp, a metal halide lamp, a semiconductor laser and a light emitting diode.

Preferably, the ink is cured by an ultraviolet-ray.

Preferably, the ink comprises a cationic polymerization ink.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Hereinafter, the preferred embodiments of the present invention will be described in detail by reference to the attached drawings. It is to be understood that the following is one embodiment only and is not to be taken by way of limitation

First Embodiment

Figure 1A:
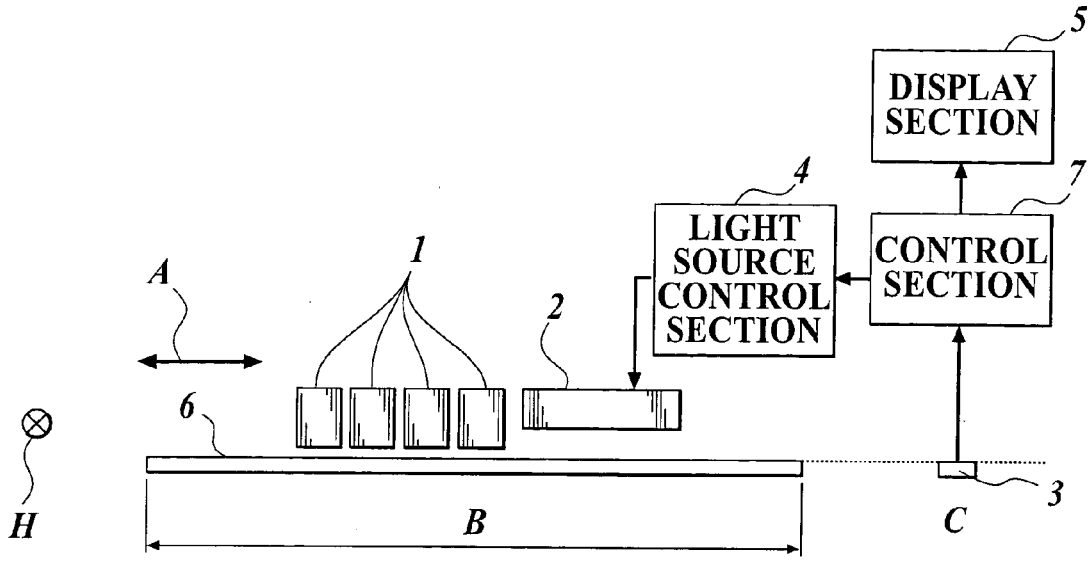
FIG. 1A is a sectional view showing an ink jet recording apparatus of the first embodiment in the present invention.

The first embodiment of the present invention will be explained referring to FIGS. 1A and 1B. FIG. 1A is a sectional view showing an ink jet recording apparatus of the first embodiment in the present invention, and FIG. 1B is a sectional view showing the ink jet recording apparatus of the first embodiment in the present invention at the time of an operation which is different from that in FIG. 1A.

As shown in FIG. 1A, the ink jet recording apparatus which is a serial head type comprises ink jet heads 1, a light source device 2, a light quantity measuring sensor 3 as a light quantity measuring section, a light source control section 4, a display section 5, a platen 6 as a supporter for the recording medium and a control section 7 for controlling the above sections and the like.

The ink jet heads 1 are an ink jet type recording head in which ink of each color of yellow (Y), magenta (M), cyan (C), black (K) and the like is jetted from a plurality of jet openings, and are well known. The ink jet heads 1 mounted on a carriage (not shown) are reciprocally moved in a main scanning direction A to scan above a recording medium such as a paper or a film which is carried on the platen 6.

Figure 1B:
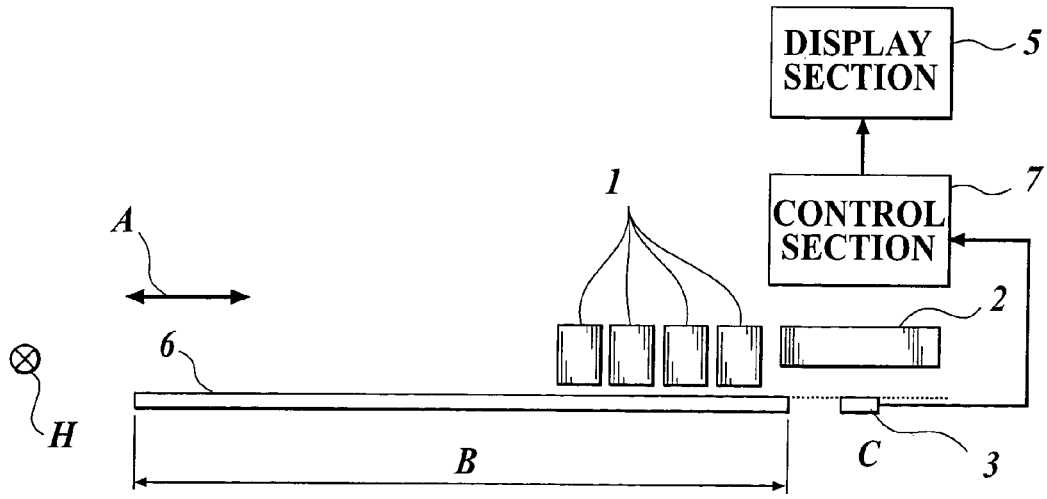
FIG. 1B is a sectional view showing the ink jet recording apparatus of the first embodiment in the present invention at the time of an operation which is different from that in FIG. 1A.

In FIGS. 1A and 1B, a carrying direction H of the recording medium (not shown) is a direction perpendicular to a surface of the paper.

A recording head scanning section which moves the recording heads 1 in a direction (main scanning direction A) perpendicular to the carrying direction H of the recording medium to carry out scanning is configured by using the carriage and a well known mechanism for linearly and reciprocally moving the carriage.

The light source device 2 is configured to be provided with one or more semiconductor lasers or light emitting diodes (LED) as a light source for emitting ultraviolet-rays (UV-rays) to cure the ink which is jetted from the ink jet heads 1 and attached to the recording medium, and is well known. The light source device 2 is mounted on the carriage together with the ink jet heads 1, so that it moves with the ink jet heads 1. As the ink, cationic polymerization ink of UV curable type is used. As the recording medium, a resin film with less absorptivity is used.

Accordingly, a light source scanning section is configured, so that the light source device 2 is moved in a direction (main scanning direction A) perpendicular to the carrying direction H of the recording medium to carry out scanning of the light sources above the recording medium. That is, in the embodiment, the light source scanning section is configured to move the light source device 2 together with the ink jet heads 1 by the recording head scanning section. Therefore, another mechanism for moving the light source device 2 is not required.

The light quantity measuring sensor 3 is a light sensor for measuring a light quantity of each light source provided on the light source device 2, and is well known.

The light source control section 4 is configured to control a light quantity of each light source provided on the light source device 2 according to a measured value of each light source by the light quantity measuring sensor 3. The light source control section 4 comprises, for example, a computer and program which is executed in the computer. The light source control section 4 is well known.

The display section 5 comprises an image display device such as a liquid crystal display device for image display, and a voice box for displaying voice is added according to need. In the embodiment, the display section 5 is configured to be able to perform both of the image display and the voice display.

The platen 6 is a member for keeping a carrying position of the recording medium at a predetermined position by supporting the recording medium from downward so as to make the distance between the recording medium and the recording heads, that is, the flight distance of the ink regular, and is well known. When the platen 6 is interposed between the light sources and the light quantity measuring sensor 3, a portion of the platen 6 comprises a transparent member such as transparent glass, resin and the like which makes at least a portion of the light from the light source pass therethrough.

Figure 2:
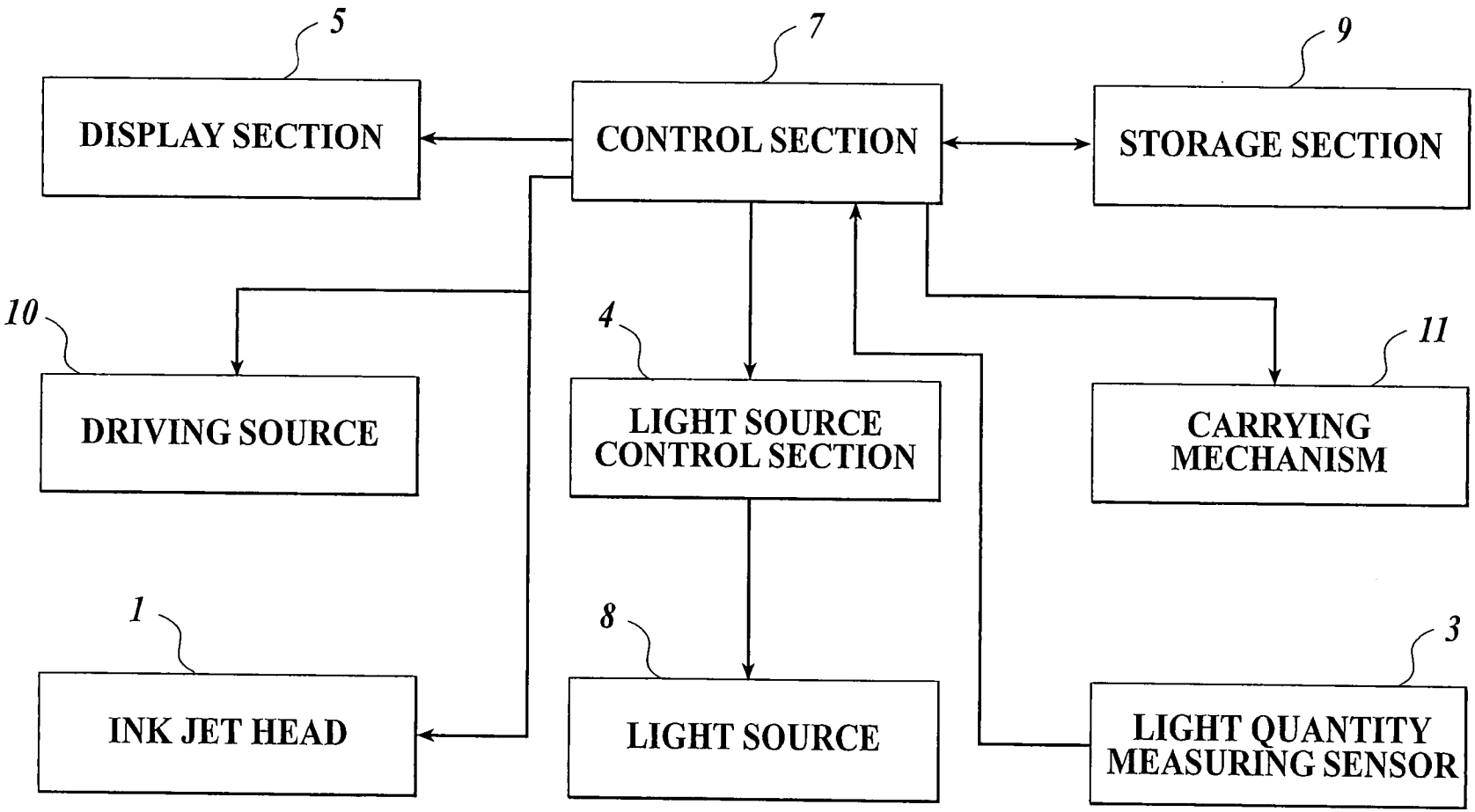
FIG. 2 is a block diagram showing a main control part of the ink jet recording apparatus of the first embodiment in the present invention.

The control section 7 is configured to control the ink jet heads 1, the light quantity measuring sensor 3, the light source control section 4, the display section 5 and the like, and when necessary, the control section 7 also controls the platen 6 and the like. The control section 7 controls the whole operations of the ink jet recording apparatus. As shown in FIG. 2, a storage section 9 which stores a control program, the desired value of a light quantity of each light source 8 to be described and the like are connected to the control section 7. The control section 7 controls each equipment according to the control program or the control data which is written in the storage section 9.

Moreover, the display section 5, the driving source 10 of the carriage, the ink jet heads 1, the light source control section 4 for controlling the light sources 8, the light quantity measuring sensor 3 and the carrying mechanism 11 are electrically connected to the control section 7. Other components such as each driving section in the ink jet recording apparatus and the like are also connected to the control section 7.

A control operation of the light sources according to the embodiment will be explained.

As shown in FIG. 1B, the control section 7 moves the light source device 2 to a measuring region C adjacent to a recording region B before or during recording operation by the ink jet heads 1 so as to dispose the light source device 2 at a position in which the light quantity measuring sensor 3 can measure a light quantity of one or more light sources 8 provided on the light source device 2.

Next, the light quantity sensor measuring 3 measures a light quantity of each light source 8 provided on the light source device 2.

The control section 7 controls the light quantity of each light source 8 provided on the light source 2 through the light source control section 4 according to the measured value of each light source 8 by the light quantity sensor measuring 3. That is, the control section controls the measured value of each light source 8 to be maintained within the range which is not less than the desired value of each light source 8. The desired values are calculated in consideration of conditions such as a curing property of the cationic polymerization ink and an amount of the dropped ink droplets on the recording medium, or experimentally precalculated to be set at a light quantity required for ink curing. The desired values are stored in the storage section 9. The control section 7 controls the light quantity by reading out the desired values from the storage section 9.

Figure 3:
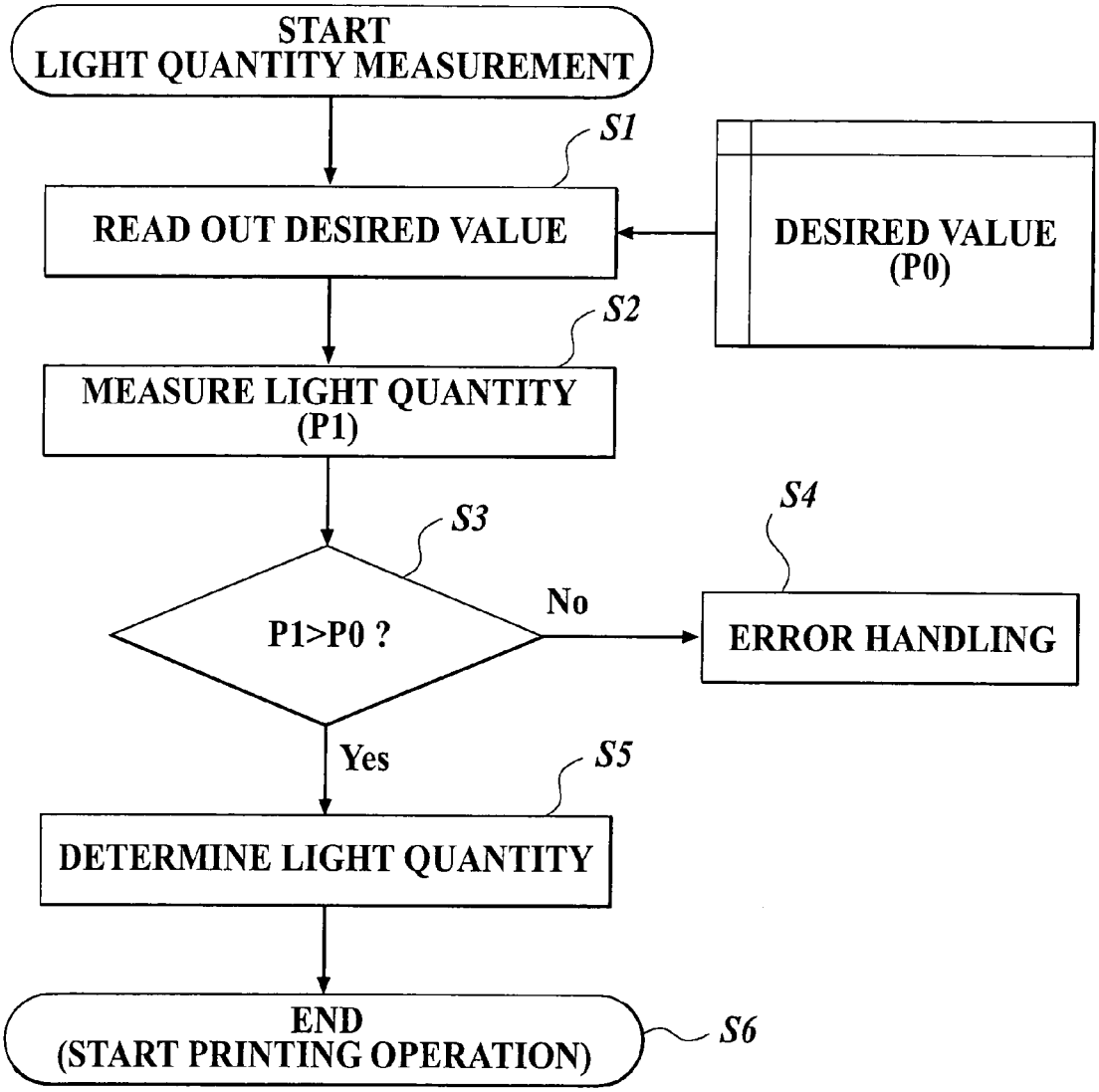
FIG. 3 is a flow chart showing one example of process by a control section.

For example, the control is performed following the flow chart shown in FIG. 3.

As shown in FIG. 3, when the light quantity measurement starts, the control section 7 reads out the desired value P0 from the storage section (Step S1), and changes a light source driving value to obtain the measured value P1 by the light quantity measuring sensor 3 (Step S2).

The control section 7 compares the desired value P0 and the measured value P1 (Step S3). When the measured value P1 exceeds the desired value P0, the control section 7 determines the light source driving value not to be less than the desired value P0 (Step S4). After that, the printing operation is performed (Step S6).

In Step 3, when the measured value P1 does not exceed the desired value P0, the control section performs an error handling S4. In the error handling S4, the display section 5 informs to a user that the measured result or the measured value P1 is less than the desired value P0. For example, the voice box makes a warning sound for lack of the light quantity, and the measured value is displayed on the image display device. At the same instant, it is preferable to display the notice that light quantity is lacking. Therefore, the measured result can be notified to the user.

In the error handling S4, the recoding operation by the ink jet heads 1 is banned. That is, the start of the recoding operation by the ink jet heads 1 is banned. If the measuring is carried out during the recording operation, the recording operation is stopped and it is informed to a user by the display section 5. Therefore, the output of the recording medium on which uncured ink still exists can be prevented, so that the reliability of the ink jet recording apparatus is improved.

The measured result may be informed to the user by the display section 5 without banning the recording operation by the ink jet heads 1 to perform the recording operation. In this case, since a user can know that the ink jet recording apparatus is operated with irradiation dose which is less than the ink curing energy, a user can take a necessary process such as radiating light by other light sources.

The embodiment is an example in which four ink jet heads 1 are provided and one light source device 2 is disposed outside the area in which the four ink jet heads 1 are mounted.

When a plurality of light sources 8 provided on the light source device 2 are provided to be disposed on one position seen from the main scanning direction A but on different positions seen from the carrying direction H of the recording medium, different light sources are moved to the measuring region of the light quantity measuring sensor 3 in order by the light source scanning section which doubles as the recording head scanning section of the ink jet heads 1 to measure a light quantity of each of the plurality of light sources 8 in order by the light quantity measuring sensor 3. Therefore, a light quantity of every light source is measured. Accordingly, since the different light sources are measured by the same light quantity measuring sensor 3, the number of the light quantity measuring sensor 3 can be less than that of the light sources 8, and the apparatus can be simplified and miniaturized.

According to the embodiment, since the light quantity of each light source 8 can be measured, it is possible to pre-detect whether light quantity which is required to cure the ink is applied to the ink on the recording medium. Since the light quantity of each light source 8 can be accurately controlled, the reliability of the ink jet recording apparatus is improved and the ink with high curing sensitivity which is cured by a relatively low-power light source 8 such as the cationic polymerization ink can be put into practical use. Accordingly, since a light source 8 with high-power is not required, the light source device 2 can be small. Therefore, the ink jet recording apparatus can be small and the cost for production can be reduced.

In addition, since the light source 2 and the ink jet heads 1 are mounted on the same carriage, both of them are uniformly incorporated in a saved space. Thus, the ink jet recording apparatus can be miniaturized.

Second Embodiment

Figure 4:
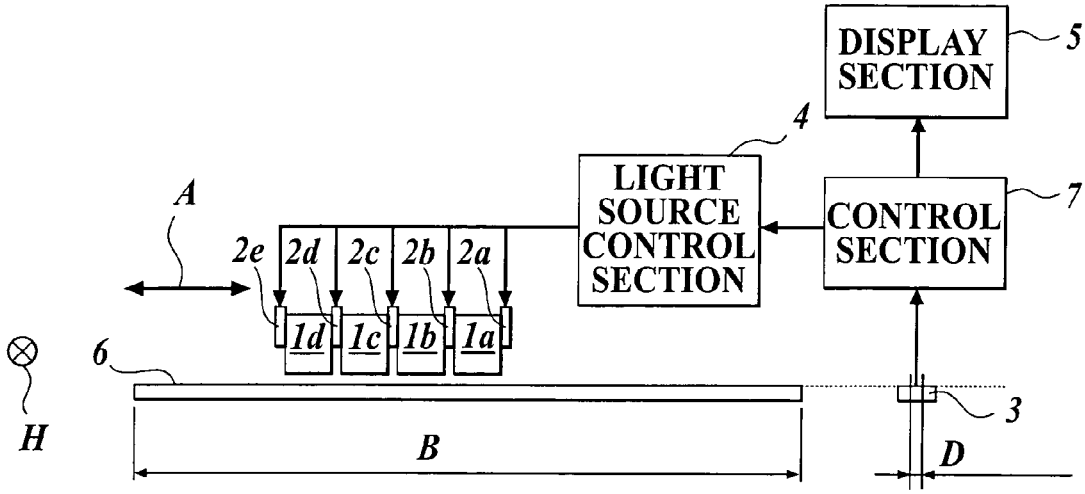
FIG. 4 is a sectional view showing an ink jet recording apparatus of the second embodiment in the present invention.

The second embodiment will be explained referring to FIG. 4. FIG. 4 is a sectional view showing the ink jet recording apparatus of the second embodiment in the present invention.

As shown in FIG. 4, the ink jet recording apparatus in the embodiment comprises the sections (1(1*a*-1*d*), 2(2*a*-2*e*), 3, 4, 5, 6, 7, 8, 9, 10, 11) which are similar to those in the first embodiment. The same sections are denoted by the same reference numerals.

However, the ink jet recording apparatus in the embodiment comprises five light source devices 2*a*-2*e* and each of the four ink jet heads 1*a*-1*d* is disposed between the light source devices 2*a*-2*e*, respectively, which is different from the first embodiment. When the carriage which mounts the ink jet heads 1*a*-1*d* and the light source devices 2*a*-2*e* moves in a left direction of the main scanning direction A on the drawing, the light source device 2*a* irradiates the ink jetted by the ink jet head 1*a* on the recording medium with ultraviolet rays (UV-rays), the light source device 2*b* irradiates the ink jetted by the ink jet head 1*b* on the recording medium with UV-rays, the light source device 2*c* irradiates the ink jetted by the ink jet head 1*c* on the recording medium with UV-rays, and the light source device 2*d* irradiates the ink jetted by the ink jet head 1*d* on the recording medium with UV-rays. This configuration is effective for irradiating the ink jetted on the recording medium with UV-rays immediately.

On the contrary, when the carriage moves in a right direction of the main scanning direction A on the drawing, the light source device 2*b* irradiates the ink jetted by the ink jet head 1*a* on the recording medium with UV-rays, the light source device 2*c* irradiates the ink jetted by the ink jet head 1*b* on the recording medium with UV-rays, the light source device 2*d* irradiates the ink jetted by the ink jet head 1*c* on the recording medium with UV-rays, and the light source device 2*e* irradiates the ink jetted by the ink jet head 1*d* on the recording medium with UV-rays.

As is described above, in the embodiment, the ink jet recording apparatus performs recording when the carriage is moved in either of the main scanning direction A. When the ink jet recording apparatus performs recording only when the carriage is moved in one of the main scanning direction A, one of the light source devices 2*a*, 2*e* at both ends is not needed.

An operation of the light source control in the embodiment will be explained.

Before or during the recording operation by ink jet heads 1*a*-1*d*, although any order is acceptable, for example, the control section 7 moves the light source device 2*a* to the measuring region D and disposes the light source device 2*a* at a position where the light quantity measuring sensor 3 can measure a light quantity of each light source 8 provided on the light source device 2*a*. The light source devices 2*a*-2*e* and the ink jet heads 1*a*-1*d* are mounted on the same carriage same as the first embodiment, so that the above described operation is performed by moving the carriage.

The light quantity measuring sensor 3 measures the light quantity of each light sources 8 provided on the light source device 2*a*.

Next, the light source device 2*b* is moved to the measuring region D and is disposed at a position where the light quantity measuring sensor 3 can measure a light quantity of each light source 8 provided on the light source device 2*b*. The light quantity measuring sensor 3 measures the light quantity of each light source 8 provided on the light source device 2*b*.

In the same manner as described above, the light source device 2*c*-2*e* are moved to the measuring region D in order and are disposed at a position where the light quantity measuring sensor 3 can measure a light quantity of each light source 8 provided in the light source device 2*c*-2*e*. The light quantity measuring sensor 3 measures the light quantity of each light source 8 provided in the light source device 2*c*-2*e* in order.

The control section 7 controls the light quantity of each light source 8 provided on the light source device 2*a*-2*e* through the light source control section 4 according to the measured value of each light source 8 provided on the light source device 2*a*-2*e*.

Other operations will be performed in the same manner as the first embodiment.

As described above, in the second embodiment, even when the plurality of light sources 8 are provided at different positions seen from the main scanning direction A, different light sources 8 are moved to the measuring region D of the light quantity measuring sensor 3 in order by the light source scanning section which is configured by mounting the light source device 2*a*-2*e* on the carriage which moves the ink jet heads 1. Thus, the light quantity measuring sensor 3 can measure the light quantity of each of the plurality of light sources 8.

Accordingly, since the different light sources are measured by the same the light quantity measuring sensor 3, the number of the light quantity measuring sensor 3 can be less than that of the light sources 8, and the apparatus can be simplified and miniaturized.

Third Embodiment

Figure 5:
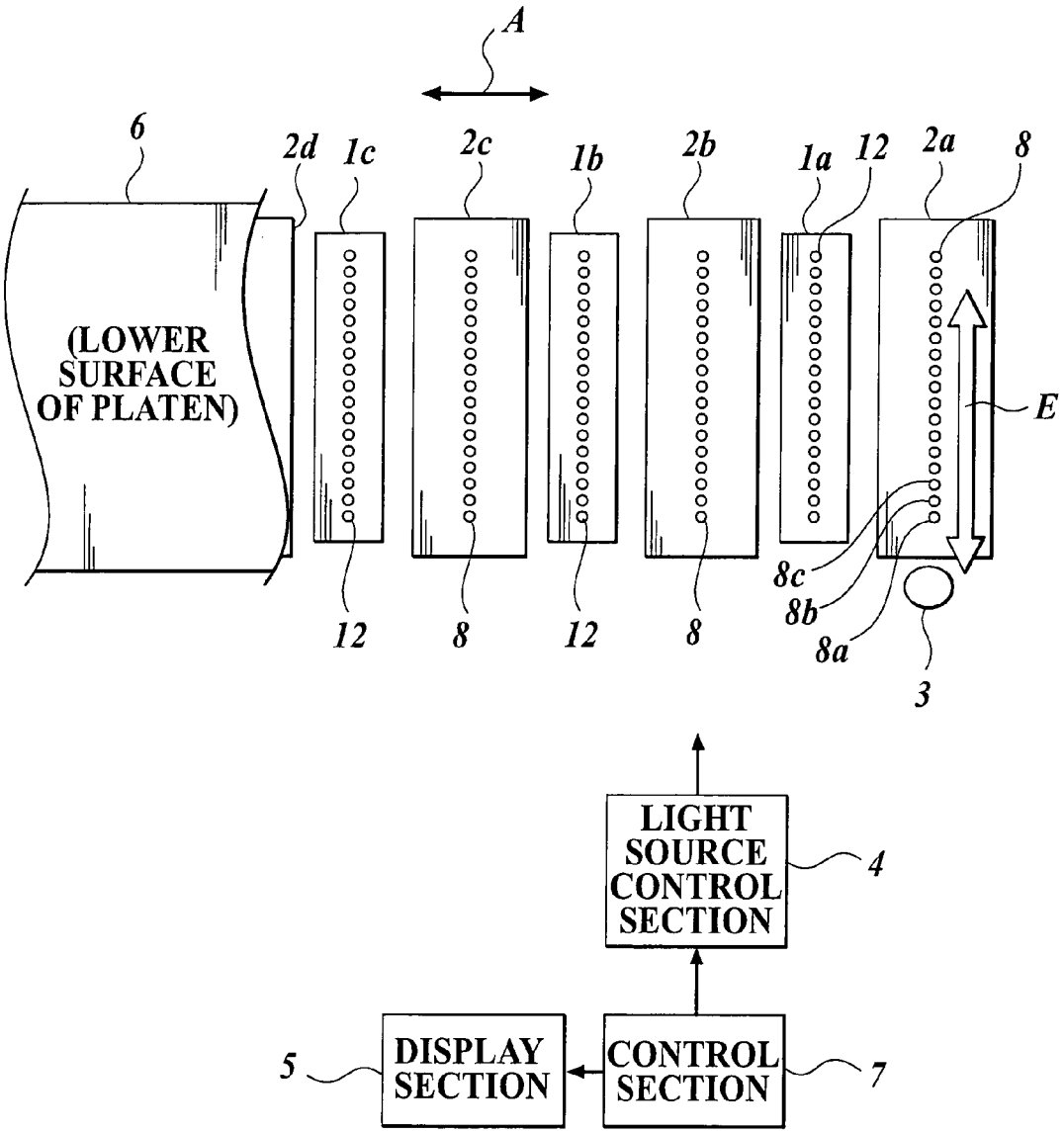
FIG. 5 is a bottom view from a lower surface side of a platen showing an ink jet recording apparatus of the third embodiment in the present invention.

The third embodiment will be explained referring to FIG. 5. FIG. 5 is a bottom view from a lower surface side of the platen showing the ink jet recording apparatus of the third embodiment in the present invention. This embodiment relates to the invention which can be added to the above described first or second embodiment. FIG. 5 is described in case of adding this embodiment to the second embodiment.

In the above described first or second embodiment, it may be effective to arrange a plurality of dot light sources 8 whose irradiation area is dot shape in line in a direction perpendicular to the main scanning direction A, that is, the carrying direction H of the recording medium, which is the third embodiment. This embodiment is for responding to the case in which a plurality of jet openings 12 are arranged in line in the carrying direction of the recording medium. That is, when the plurality of jet openings 12 are arranged in line in the carrying direction of the recording medium, one light source cannot irradiate all the ink dots with UV-rays. Therefore, in the embodiment, the plurality of dot light sources 8 are arranged in line in the carrying direction of the recording medium which is same as a direction of the arrow E in FIG. 5.

However, as explained in the above described first or second embodiment, the light source scanning section can move only in the main scanning direction A. Since the plurality of light sources are provided at different positions seen from the direction E, a light quantity of every light source cannot be measured individually by only one light source 3 which is fixed. If a plurality of light quantity measuring sensors 3 are arranged in line in the direction E for measuring the light quantity of every light source, the number of the light quantity measuring sensors 3 increases.

Therefore, in the embodiment, the light quantity measuring sensor 3 is reciprocally moved in the direction E.

That is, a scanning section is provided, which moves the light quantity measuring sensor 3 in the carrying direction E of the recording medium so as to measure a light quantity of each of the plurality of light sources in order by the light quantity measuring sensor 3. The scanning section can be configured by the well known moving mechanism, driving source and control section.

Figure 6:
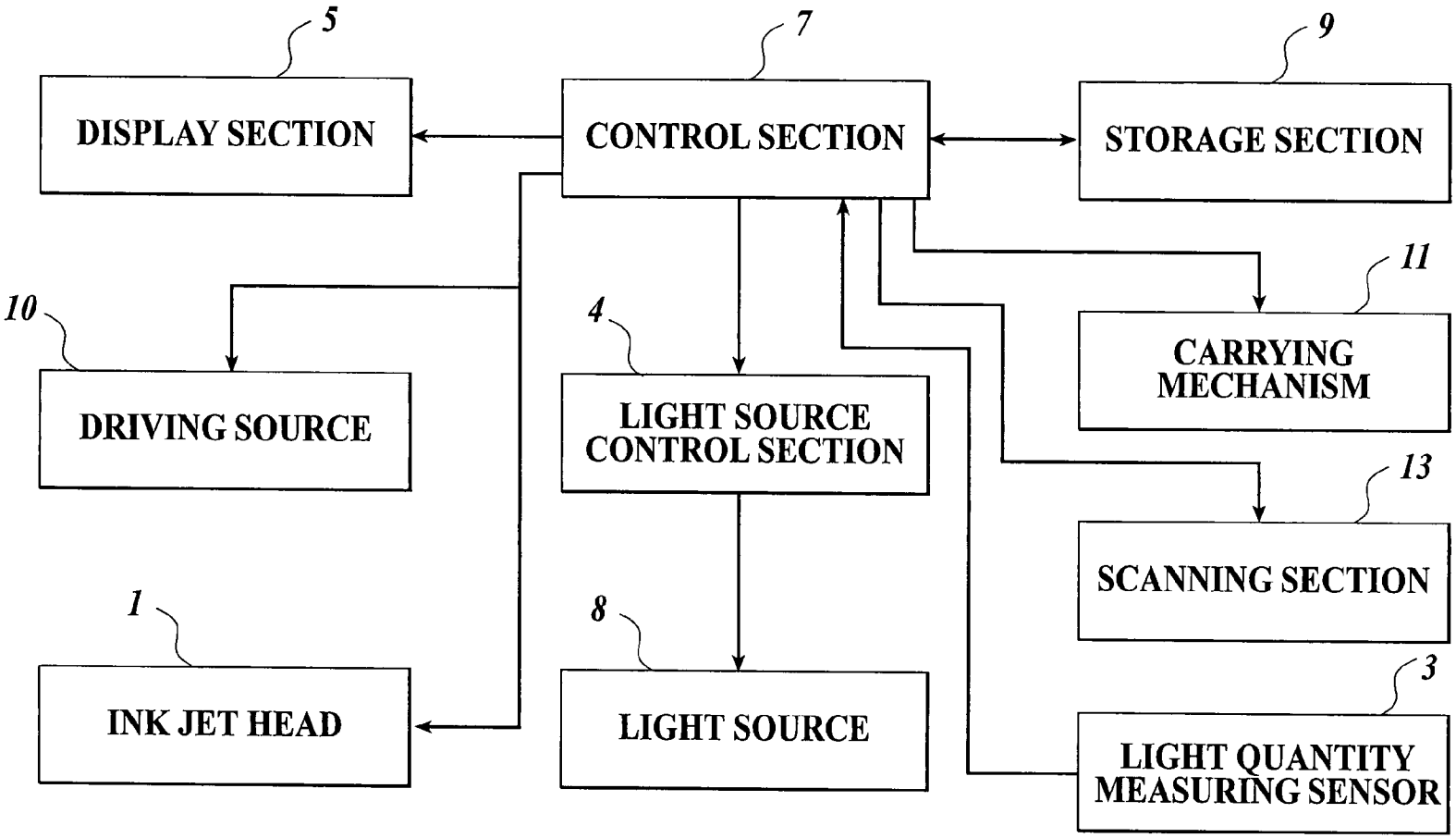
FIG. 6 is a block diagram showing a main control part of the ink jet recording apparatus of the third embodiment in the present invention.

In the embodiment, the control is performed by the control section 7 similar to the above described first and second embodiments. As shown in FIG. 6, the storage section 9 which stores the control program, the control data such as the desired value of a light quantity of each light source 8 to be described and the like, the light quantity measuring sensor 3 and the like are connected to the control section 7, and the configuration thereof is similar to that in FIG. 2.

However, in the embodiment, a scanning section 13 for moving the light quantity measuring sensor 3 as described above is further connected to the control section 7.

An operation of the light source control in the embodiment will be explained based on FIG. 5. A sectional view thereof is same as FIG. 4.

Before or during the recording operation by ink jet heads 1*a*-1*d*, although any order is acceptable, for example, the control section 7 moves the light source device 2*a* to the measuring region D and disposes the light source device 2*a* at a position where the light quantity measuring sensor 3 can measure a light quantity of each light source provided on the light source device 2*a*. The light source devices 2*a*-2*e* and the ink jet heads 1*a*-1*d* are mounted on the same carriage same as the first embodiment, so that the above described operation is performed by moving the carriage.

The light quantity of each of the plurality of light sources 8 provided on the light source device 2*a* and arranged in line in the direction E is measured in order by the light quantity measuring sensor 3 while moving the light quantity measuring sensor 3 in the direction E.

Next, the light source device 2*b* is moved to the measuring region D and is disposed at a position where the light quantity measuring sensor 3 can measure a light quantity of each light source provided on the light source device 2*b*. The light quantity of each of the plurality of light sources 8 provided on the light source device 2*b* and arranged in line in the direction E is measured in order by the light quantity measuring sensor 3 while moving the light quantity measuring sensor 3 in the direction E.

In the same manner as described above, the light source devices 2*c*-2*e* are moved to the measuring region D in order and are disposed at a position where the light quantity measuring sensor 3 can measure a light quantity of each light source provided on the light source devices 2*c*-2*e*. The light quantity of each of the plurality of light sources 8 provided on the light source devices 2*c*-2*e* and arranged in line in the direction E is measured in order by the light quantity measuring sensor 3 while moving the light quantity measuring sensor 3 in the direction E.

The control section 7 controls the light quantity of each light source 8 provided on the light source device 2*c*-2*e* according to the measured values of each light source 8. Other operations will be performed in the same manner as the first embodiment.

Accordingly, since the light sources at different positions are measured by the same light quantity measuring sensor 3, only one light quantity measuring sensor 3 can be used. Thus, the apparatus can be simplified and miniaturized.

Fourth Embodiment

The fourth embodiment will be explained. In the ink jet recording apparatus in the embodiment, the configuration of each section and the like (refer to FIGS. 4 and 5) and the connection between the control section 7 and each section and the like (refer to FIG. 6) are similar to those in the third embodiment. However, an operation at the time of inspecting the light sources differs from that in the third embodiment. In the ink jet recording apparatus in the embodiment, when at least one measured value of a light source (e.g. first light source) is less than the desired value thereof in the measured value of light quantity of each of the plurality of light sources 8 measured by the light quantity measuring sensor 3, a light quantity of another light source 8 (e.g. second light source) which is different from the light source 8 (e.g. first light source) having the light quantity less than the desired value thereof is increased.

Figure 7:
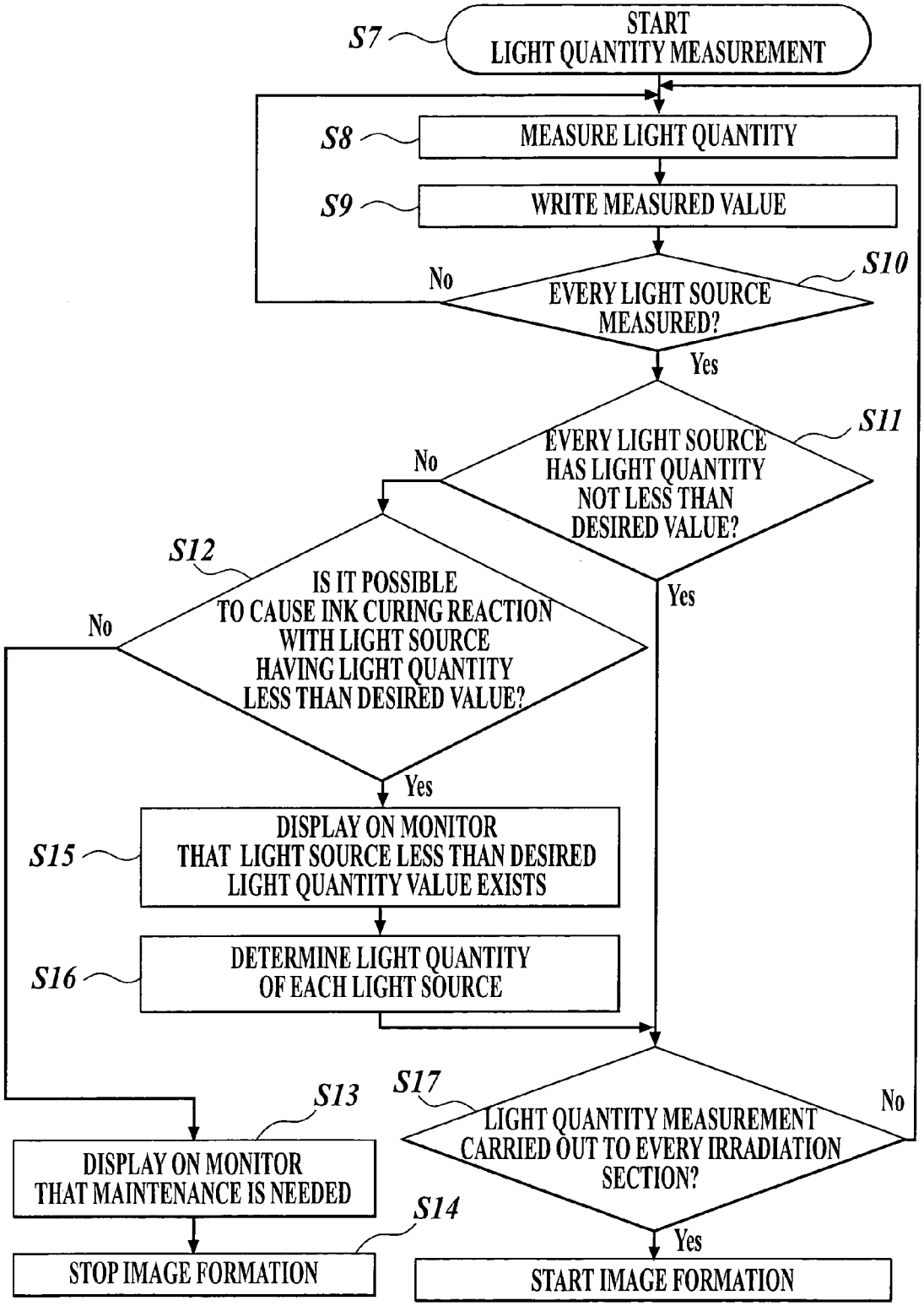
FIG. 7 is a flow chart showing a control procedure performed at the time of inspection by the control section in an ink jet recording apparatus of the fourth embodiment in the present invention.

An operation of the ink jet recording apparatus in the embodiment at the time of inspecting the light sources will be explained referring to FIGS. 4-7. FIG. 7 is a flow chart showing the control procedure.

First, when an image formation starts, the control section 7 moves the carriage to a position where the light source device 2*a* faces the light quantity measuring sensor 3 to start light quantity measurement of each light source 8 (Step S7).

The control section 7 controls the scanning section 13 to make a light source 8*a* mounted on the light source device 2*a* and the light quantity measuring sensor 3 face each other, and lights the light source 8*a*. The light quantity measuring sensor 3 measures a light quantity of the light source 8*a* (Step S8), and the control section 7 writes the measured value which is input from the light quantity measuring sensor 3 into the storage section 9 for storing it (Step S9). The control section 7 repeats Step S8 and Step S9 until measuring a light quantity of every light source 8 mounted on the light source device 2*a* by controlling the scanning section 13 to make each light source 8 and the light quantity measuring sensor 3 face each other (Step S10).

When the light quantity measurement of every light source 8 mounted on the light source device 2*a* is completed, the control section 7 reads out the desired value and a measured value of each light source 8 to compare them, respectively (Step S11). The desired values are determined on the basis of values calculated in consideration of conditions such as a curing property of cationic polymerization ink which is used, jetting amount of ink to the recording medium and the like, empirical values and the like, and are set to the light quantity which is needed for ink curing.

When at least one light source 8 (e.g. first light source) has a light quantity less than the desired value thereof in the measured values of each light source 8, the control section 7 increases a light quantity of another light source 8 (e.g. second light source) which has a light quantity not less than the desired value thereof through the light source control section 4 to judge whether ink curing reaction is caused or not (Step S12). When the control section 7 judges that the ink curing reaction is not caused, the control section 7 makes the display section 5 display that maintenance is needed (Step S13) because a plurality of light sources 8 are required to be maintained. The control section 7 stops image formation (Step S14).

When the control section 7 judges that the ink curing reaction can be caused, the control section 7 makes the display section 5 display that at least one light source 8 (e.g. first light source) has a light quantity less than the desired value thereof (Step S15), and determines a light quantity of each light source 8 which has a light quantity not less than the desired value thereof (Step S16). The control section 7 makes the light source control section 4 increase the light quantity of each light source 8 having the light quantity not less than the desired value thereof to cure the ink jetted in a region which was to be irradiated with light by the light source 8 (e.g. first light source) having the light quantity less than the desired value thereof. For preventing difference in dot diameters, for example, when the light source 8*a* shown in FIG. 5 has a light quantity less than the desired value thereof, it is preferable to increase a light quantity of at least one of the light sources 8*b*, 8*c* which are in proximity to the light source 8*a*. It is preferable that the light quantity to be increased of the light source 8*b* or 8*c* is set by multiplying by a predetermined coefficient on the basis of profiles of the light sources 8*a*, 8*b*, 8*c* so as to make the irradiating light quantity on the surface which faces the light source 8*a* be not less than the irradiating light quantity on the surface which faces the light source 8*a* in case that the light source 8*a* irradiated with the desired light quantity. Because the light intensity differs depending upon points, when controlling the light source 8*b* or 8*c* to have a light quantity equal to the desired value of the light source 8*a* for supplementing the decrease of light quantity of the light source 8*a*, the irradiation intensity may not be enough at a portion of platen which faces the light source 8*a* although the light quantity at a portion of platen which faces the light source 8*b* or 8*c* is increased.

When the control section 7 judges that every light source 8 mounted on the light source device 2 can irradiate with the light quantity not less than the desired value thereof in Step 11 S11, or determines the light quantity of each light source 8 in Step S16, the control section 7 repeats the above steps until inspecting all light source devices 2*a*-2*e* mounted on the carriage by controlling the carriage to make each light source device 2*a*-2*e* and the light quantity measuring sensor 3 face each other (Step S17). After the inspection for all light source devices 2*a*-2*e* are completed, the control section 7 starts image formation.

According to the ink jet recording device in the embodiment, when at least one light source 8 (e.g. first light source) has a light quantity less than the desired value thereof in the measured values of each light source 8, the control section 7 increases a light quantity of another light source 8 (e.g. second light source) which differs from the light source 8 (e.g. first light source) having the light quantity less than the desired value through the light source control section 4. Thus, even when a light quantity of a light source 8 (e.g. first light source) decreases by degradation, ink mist or the like, the decrease of light quantity is supplemented by another light source 8 (e.g. second light source), so that the lighting intensity enough to cause ink curing reaction can be achieved. When a light source 8 having a light quantity less than the desired value thereof appears in other light sources 8 while carrying out image formation, the lighting intensity enough to cause ink curing reaction can be achieved by increasing light quantity of the remaining light sources 8 again. When the lighting intensity enough to cause ink curing reaction cannot be achieved because the number of light sources 8 having a light quantity less than the desired value thereof increases, workers carry out maintenance such as removing the ink which is the cause of the decrease of light intensity or exchanging degraded light sources 8. The number of maintenances can be decreased by adjusting the timing of each maintenance, thereby reducing the load on workers.

A portion which was to be irradiated with light by a light source 8 having a light quantity less than the desired value thereof can be irradiated with light without delay. Therefore, difference in dot diameters can be prevented to stabilize an image.

Since the carriage is scanned to face each of the plurality of light sources 8 and the light quantity measuring sensor 3 each other, a light quantity of every light source 8 can be measured without providing the light quantity measuring sensor 3 as many as the light sources 8.

Since the carriage is scanned with the ink jet heads 1*a*-1*d*, the ink jet heads 1*a*-1*d* can be unified with the light sources 8. Thus, the ink jet recording apparatus per se can be small.

When the control section 7 recognizes a measured value less than the desired value, the control section 7 makes the display section 5 inform the comparison result. Thus, workers can recognize that maintenance is needed in the near future. Accordingly, workers can make the necessary preparations for maintenance before the timing of maintenance so as to effectively perform maintenance.

Figure 8:
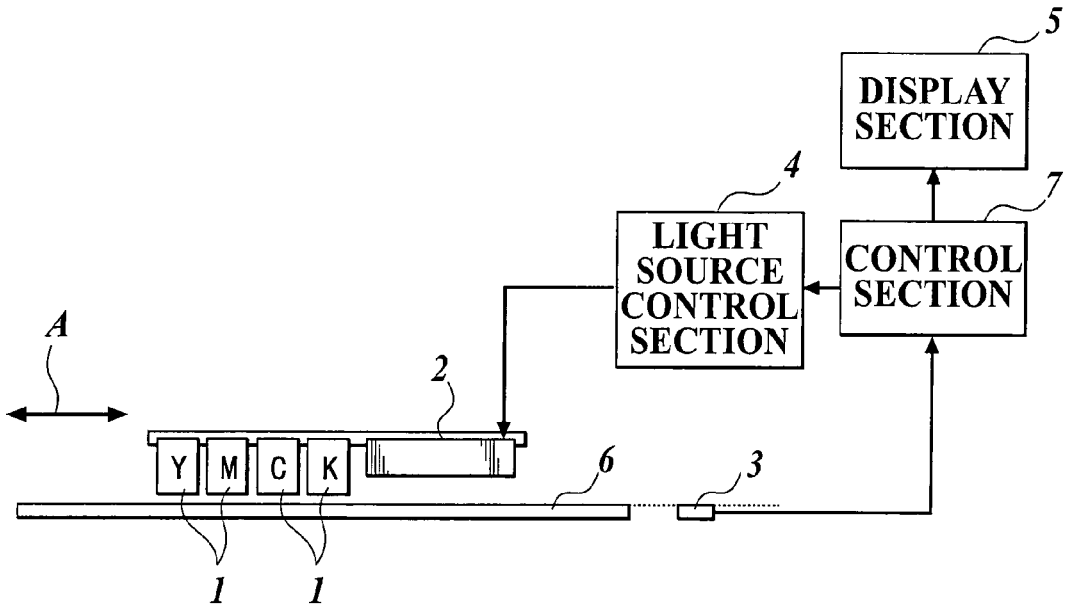
FIG. 8 is a side view showing a preferred structure of a modification of the ink jet recording apparatus of the fourth embodiment in the present invention.

In the embodiment, it is explained that the ink jet heads 1*a*-1*d* and the light sources 2*a*-2*e* are alternately disposed on the carriage, however, any arrangement can be employed, provided that the ink jetted from the ink jet heads 1*a*-1*d* and attached to the recording medium can be irradiated. For example, as shown in FIG. 8, one light source 2 may be disposed on the side of a plurality of recording heads 1. In this case, a plurality of light sources are mounted on the light source device 2.

Figure 9:
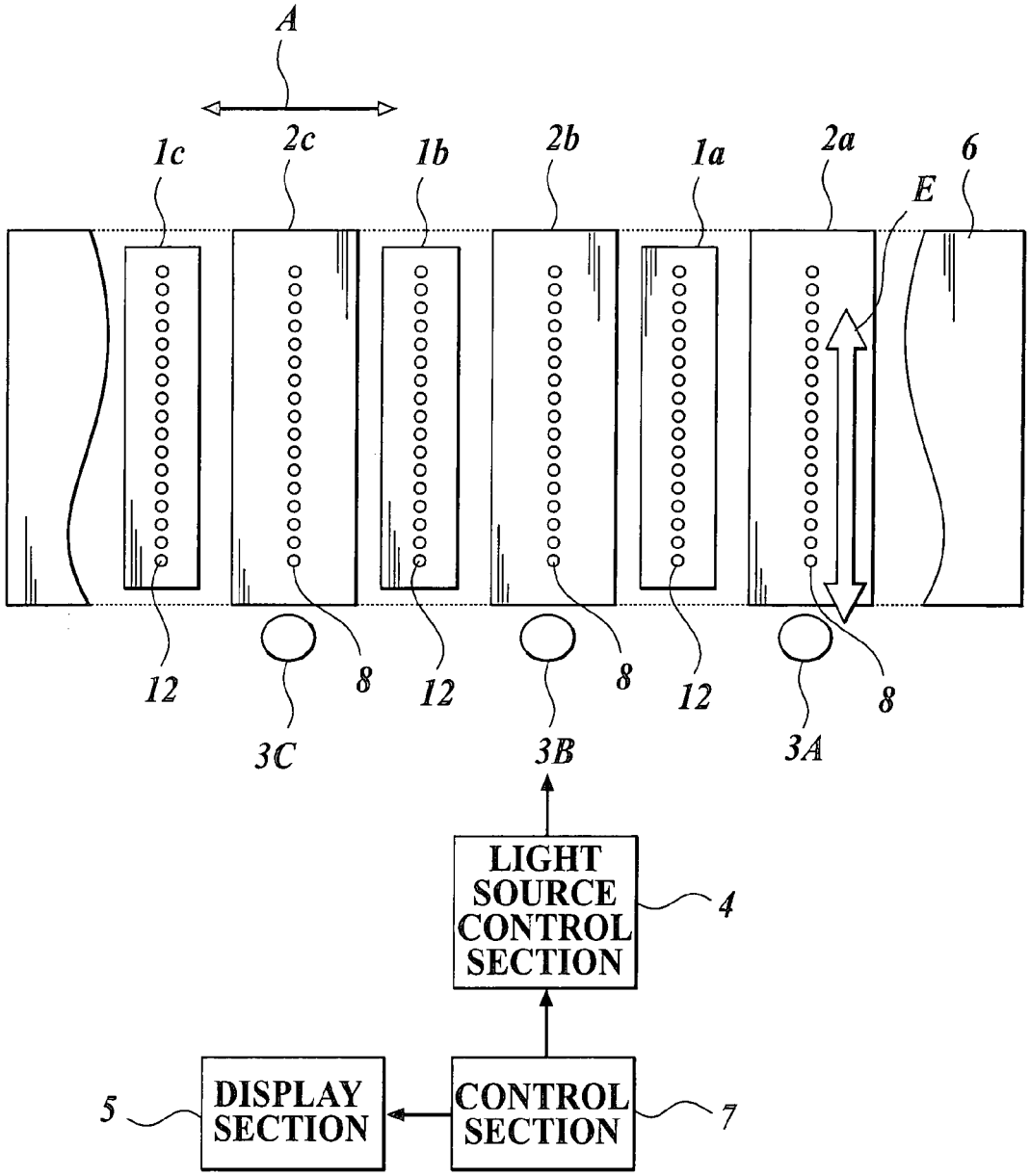
FIG. 9 is a bottom view showing a modification of a recording head, a platen, a light irradiation device and a light quantity measuring sensor in the ink jet recording apparatus of the fourth embodiment in the present invention at the time of inspection.

In the embodiment, a light quantity of every light source 8 of the plurality of light source devices 2 is measured by one light quantity measuring sensor 3, however, as shown in FIG. 9, light quantity measuring sensor 3A, 3B, 3C, . . . may be provided corresponding to the light source devices 2*a*, 2*b*, 2*c*, . . . , respectively. Therefore, light quantity measurement can be carried out to each light source device 2*a*, 2*b*, 2*c*, . . . at the same time. Accordingly, measurement time can be shortened.

In the embodiment, the light quantity measuring sensor 3 is provided on the side of the platen 6 and is scanned along an arrangement direction of the light sources 8. However, when the platen 6 is formed by a material which makes light from light sources 8 pass therethrough, light quantity measuring sensors 3A, 3B, 3C, . . . may be provided below the platen 6 and may be scanned to face the light source devices 2*a*, 2*b*, 2*c*, . . . as shown in FIG. 9.

Figure 10:
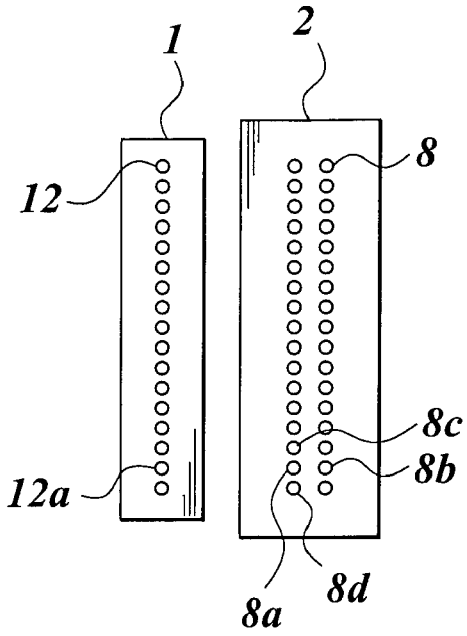
FIG. 10 is a bottom view showing a modification of light sources in the ink jet recording apparatus of the fourth embodiment in the present invention.

In the embodiment, the plurality of light sources 8 are arranged in a line on the light source device 2 in a direction perpendicular to the scanning direction, however, the light sources 8 may be arranged in a plurality of lines. For example, as shown in FIG. 10, dot shape light sources 8 such as LED and the like may be arranged in two lines on the light source device 2 in a direction perpendicular to the scanning direction. In this case, when a light source 8*a* has a light quantity less than the desired value thereof, it is preferable to increase a light quantity of at least one of the light sources 8*b*, 8*c*, 8*d* which are in proximity to the light source 8*a* for supplementing the decreased light quantity. It is preferable that the light quantity to be increased of at least one of the light sources 8*b*, 8*c*, 8*d* is set by multiplying by a predetermined coefficient on the basis of profiles of the light sources 8*a*, 8*b*, 8*c*, 8*d* so as to make the irradiating light quantity on the surface which faces the light source 8*a* be not less than the irradiating light quantity on the surface which faces the light source 8*a* in case that the light source 8*a* irradiated with the desired light quantity.

By increasing light quantity of the light source 8*b* which is aligned with the light source 8*a* in a direction perpendicular to the scanning direction, it can be prevented more certainly that a dot diameter of the ink jetted from a jet opening 12*a* which corresponds to the light sources 8*a*, 8*b* differs from a dot diameter of other ink dots.

Figure 11:
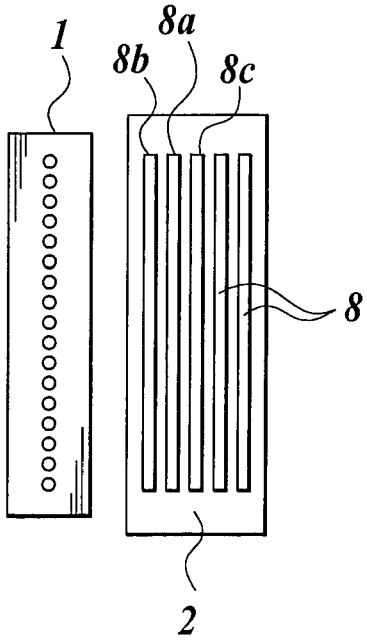
FIG. 11 is a bottom view showing another modification of light sources in the ink jet recording apparatus of the fourth embodiment in the present invention.

When the light sources are arranged in a plurality of lines in a direction perpendicular to the scanning direction, the light sources may not be a dot shape. As shown in FIG. 11, a plurality of bar shape light sources 8 such as fluorescent lamp and the like may be used. When the bar shape light sources 8 are used, a light quantity of every light source 8 can be measured without making the light quantity measuring sensor 3 scan in the carrying direction.

In this case, when the light source 8*a* has a light quantity less than the desired value thereof, it is preferable to increase a light quantity of at least one of the light sources 8*b*, 8*c* which are proximity to the light source 8*a* for supplementing the decreased light quantity.

Fifth Embodiment

Figure 12:
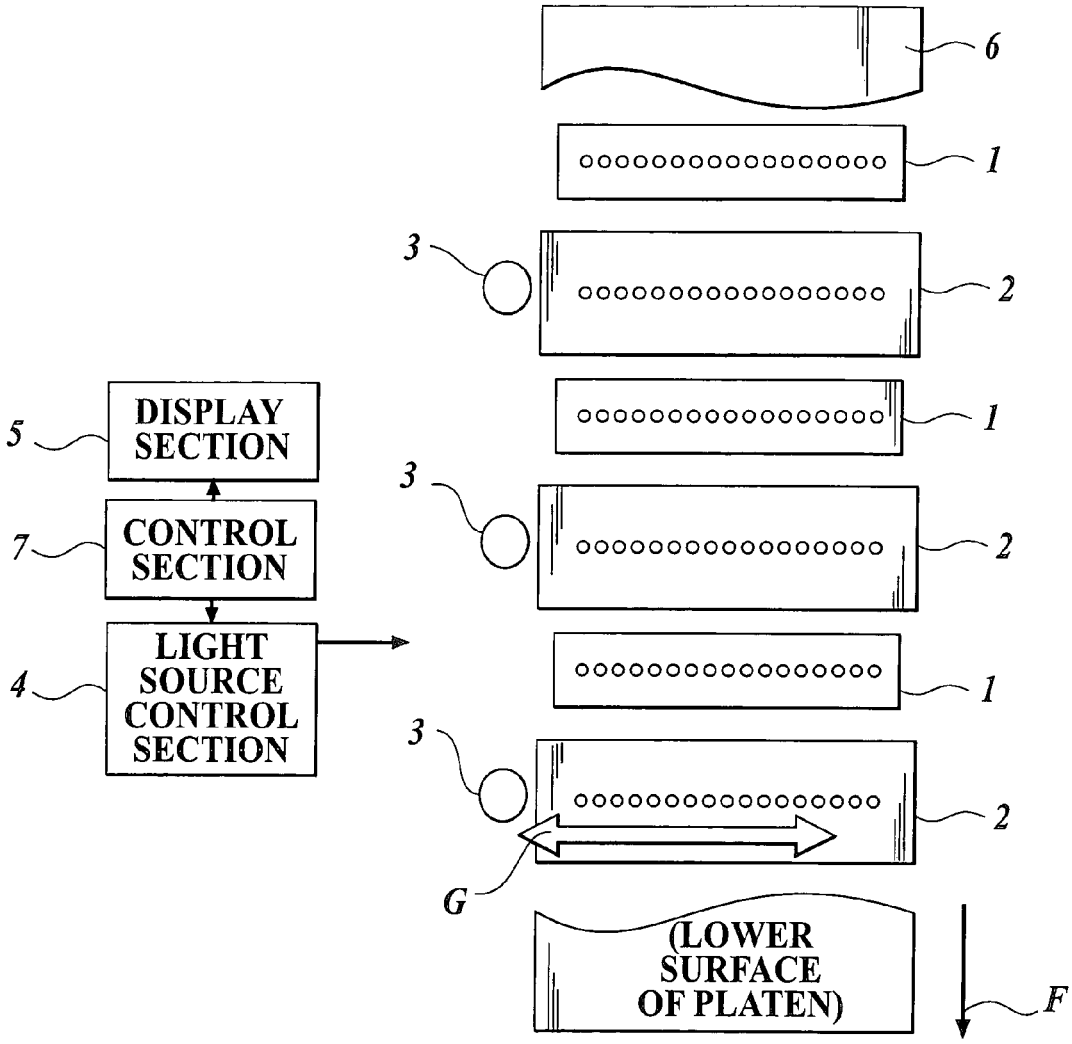
FIG. 12 is a bottom view from a lower surface side of a platen showing an ink jet recording apparatus of the fifth embodiment in the present invention.

The fifth embodiment will be explained referring to FIG. 12. FIG. 12 is a bottom view from a lower surface side of the platen showing an ink jet recording apparatus of the fifth embodiment in the present invention.

As shown in FIG. 12, the embodiment is for a line head type. In the line head type, the ink jet heads 1 and the light source devices 2 are fixed.

In the line head type, the jet openings 12 provided on the ink jet heads 1 form a line in a direction perpendicular to a carrying direction F of the recording medium. In the embodiment, a plurality of light sources 8 are provided so as to form a line in a direction G which is in parallel with the line of the jet openings 12 for the same purpose as in the third embodiment. For the purpose of simplifying the light quantity measuring sensor 3 as with the third embodiment, in the embodiment, a scanning section which moves the light quantity measuring devices 3 in the direction G to measure a light quantity of each of the plurality of light sources 8 in order by the light quantity measuring sensors 3 is provided. The scanning section can be configured by the well known moving mechanism, driving source and control section.

As shown in FIG. 12, when a plurality of lines of the light sources 8 are provided in the direction G because the plurality of light source devices 2 are provided, the light quantity measuring sensors 3 are provided corresponding to each line, respectively, to perform the following control operations at the same time. Each light quantity measuring sensor 3 is disposed at a position where a light quantity of each light source 8 of a line corresponding thereto in the carrying direction F of the recording medium can be measured.

The platen 6 is disposed between the light quantity measuring sensors 3 and the light sources 8. For enabling the light quantity measurement in the following control operations, at least a portion of the platen 6 just below the light sources 8 comprises through holes for passing the light therethrough or a transparent portion. In the line heads, since the light sources 8 are fixed, the light quantity measurement can be performed by partially providing holes for passing the light therethrough or a transparent portion.

An operation of the light source control in the embodiment will be explained.

Before or during the recording operation by ink jet heads 1, scanning is carried out so as to sequentially measure a light quantity of each light source 8 disposed in line on each of the light source devices 2 in the direction G while moving each of the light quantity measuring sensors 3 in the direction G.

The control section 7 controls a light quantity of each light source 8 through the light source control section 4 according to the measured value of each light source 8.

Other operations will be performed in the same manner as the first embodiment.

According to the embodiment, in the ink jet recording apparatus of line head type, since different light sources are measured by the same light quantity measuring sensor 3, the number of the light quantity measuring sensor 3 can be reduced. Thus, the ink jet recording apparatus can be simplified and miniaturized.

In the first to fourth embodiments, the measuring region may be disposed in the recording region B. In this case and in the fifth embodiment, a light quantity is measured when the recording medium does not exist between the light sources 8 and the light quantity measuring sensor 3. That is, the light quantity measurement of each light source 8 can be performed from the time a back end of a recording medium passed between the light source 8 and the light quantity measuring sensor 3 to the time a front end of a next recording medium is carried between the light sources 8 and the light quantity measuring sensor 3.

In the first to fourth embodiments, as the time interval to perform the light quantity measurement of each light source 8 by the light quantity measuring sensor 3, the light quantity measurement can be performed every one scanning of image formation as a minimum unit according to the above described embodiments. When the light quantity measurement is performed frequently such as every one scanning of image formation, a change which occurs in a relatively short period of time such as a decrease of irradiation amount by ink mist can immediately be detected.

When a decrease of printing speed is considered or when a problem is a change of light quantity in a relatively long period of time (for example, decrease of output of a light source by the degradation in the electric system including the light quantity measuring sensor 3), the light quantity measurement is carried out with the light quantity measuring sensor 3 by utilizing the starting time or the standby time of waiting the instructions such as a width of paper or a printing job to be input. In addition, the light quantity measurement may be carried out by the light quantity measuring sensor 3 in consideration of the preset elapsed time, that is, the total operating time of the apparatus or the length of time that has elapsed since the apparatus was activated.

Each technical term that is adaptable to the embodiments in the invention will be explained.

<Jetting Amount>

Ink jetting amount per dot is 2 pl-20 pl (pico liter), and preferably 4 pl-10 pl. When the ink jetting amount per dot exceeds 20 pl, it is difficult to perform a high definition printing, and when the ink jetting amount per dot is less than 2 pl, it diminishes in thickness of a formed image.

<Dot Diameter>

The dot diameter formed on the recording medium is 50 μm-200 μm, preferably 50 μm-150 μm, and more preferably 55 μm-100 μm. When the dot diameter is less than 50 μm, it diminishes in thickness of a formed image, and when the dot diameter exceeds 200 μm, it is difficult to perform a high definition printing.

<No Water and Organic Solvent>

Preferably, the ink which is used does not substantially contain water and organic solvent, that is, the content of water and organic solvent is less than 1 wt %.

<Ink Jet Type>

As an actuating force for ink jetting of the ink jet printer, it is preferable to utilize a piezoelectric actuation of a piezoelectric element, which is capable of wide application to the ink and in which the high-speed jetting is possible. Specifically, for example, as described in Japanese Patent Publication No. Hei 4-48622, the ink jet printer is the ink jet head type in which an electrode layer is formed inside a fine groove formed on a piezoelectric base substance and further being covered with an insulating layer for forming an ink path.

<Irradiated Radiation Source>

Various radiation sources which radiate UV-rays, electron beams, X-rays, visible rays or infrared rays can be utilized. However, considering the curing property and the cost of radiation source, the radiation source which radiates UV-rays is preferable. As the UV radiation source, a mercury lamp, metal halide lamp, excimer lamp, UV laser or LED can be used.

A basic irradiation method is disclosed in Japanese Application Patent Laid-Open Publication No. Sho 60-132767. According to the publication, a light source is provided on both sides of a head unit, and a head and a light source are scanned by a shuttle type. The irradiation is performed in a certain length of time after ink is jetted. Further, another light source which is not driven is used to complete ink curing. There is disclosed in WO9954415 irradiation methods such as a method using optical fiber and a method in which a collimated light source is directed to a mirror surface provided on a side surface of a head unit to irradiate a recorded portion with UV-rays. In the embodiments in the present invention, any of these irradiation methods is applicable.

Specifically, a strip-shaped metal halide lamp bulb or ultraviolet lamp bulb is preferable. It is possible to construct a radiation source at lower cost by practically fixing a radiation source on an ink jet printer and eliminating moving parts.

It is preferable that irradiation is performed at every image formation of each color. That is, it is a preferred embodiment that two radiation sources are provided in any exposure method to be employed, and ink curing is completed by the second radiation source. This contributes to achieving high wetting property of the jetted ink of the second color, adhesiveness between inks, and constructing a radiation source at lower cost.

It is preferable to vary the exposure wavelength or exposure illumination of the first radiation source from that of the second radiation source. The first irradiation energy is set smaller than the second irradiation energy, that is, the first irradiation energy is set to 1 to 20% of total irradiation energy, or preferably to 1 to 10%, or more preferably to 1 to 5%. Irradiation at different lighting intensity helps achieve favorable molecular weight distribution after being cured. That is, if irradiation at high lighting intensity is performed at a time, high polymerization ratio is attained but the molecular weight of the polymerized composition is lower and accordingly necessary strength cannot be achieved.

By using longer wavelength in the first irradiation than in the second irradiation, the surface layer of the jetted ink can be cured in the first irradiation and hence blurredness can be suppressed, and the ink layers close to the recording medium to which irradiated radiation hardly reaches can be cured in the second irradiation and hence adhesiveness can be improved. The wavelength of the second irradiation is preferred to be longer in order to accelerate curing of the inside of ink.

<Timing of Irradiation>

The above-mentioned ink is employed and the ink is heated to a constant temperature and also that the elapse time from the jetting of the ink to the irradiation is set to 0.01 to 0.5 second, or preferably to 0.01 to 0.3 second, or more preferably to 0.01 to 0.15 second. By controlling the elapse time from the jetting of the ink to the irradiation extremely shorter, the jetted ink can be prevented from being blurred before it is cured. Beside, even in case a porous recording medium is used, the ink can be exposed to the irradiation light before the ink penetrates deep into pores to which the light cannot reach, and hence residual unreacted monomer can be minimized and smell can be reduced. This means that use of the ink with high viscosity produces a remarkable synergy effect. Specially, a remarkable effect can be obtained by using ink with viscosity of 35 to 500 mPa.s at 25 degree C. With the recording method as above, sizes of the dots jetted even on various types of recording media of different surface wetting property can be kept constant and hence the image quality can be improved. In order to attain an excellent color image, it is preferable to superpose colors in order of the brightness, starting from the lowest. If ink with low brightness is superposed on the top, the irradiation light hardly reaches the lower layers of the ink, and hence curing sensitivity is apt to deteriorate, residual monomer to increase, smell to be caused, and adhesiveness to decrease. Irradiation can be performed in one time after all colors of ink are jetted, however, individual irradiation on each color is preferable in view of accelerated curing.

On a unit equipped with heads of different colors, it is preferable to construct the unit so that irradiation light is permeable among the colors. To be concrete, a portion between the heads is made of irradiation permeable member or no member is disposed between the heads. A simple construction as above is preferable because irradiation can be performed for each color immediately after the ink is jetted and, in particular, the next color to follow can be prevented from blurredness and also, in two-directional printing, difference between the blurredness in one direction and in the other can be prevented (preventing difference between the colors in one direction and in the other).

<Ink Heating and Head Temperature Control>

It is preferable to heat the above ink to 30 to 150 degree C., or more preferably to 40 to 100 degree C., so as to jet the ink with low viscosity in view of stable jetting of the ink. If the temperature is below 40 degree C. or above 150 degree C., the ink cannot be jetted smoothly. Because light curable ink has generally higher viscosity than water ink, the range of viscosity variation caused by temperature variation is greater. Because the viscosity variation gives a direct and remarkable effect on a droplet size and droplet jetting velocity, resulting in poor image quality, the ink temperature needs to be kept as stable as possible. The control range over the ink temperature is set to +−5 degree C., or preferably to +−2 degree C., or more preferably to +−1 degree C. The recording device is equipped with a means for stabilizing the ink temperature, and the portions to be kept at a constant temperature include all tubes and parts from the ink tank (or intermediate tank if provided) to the jetting surface of the nozzles.

For the temperature control, it is preferable to provide a plurality of temperature sensors on various points on the tubing and heat control is employed in accordance with the ink flow rate and ambient temperature. It is preferable that the head unit to be heated is thermally isolated or insulated so as not to be affected by the temperature of the apparatus itself and of the ambient. To reduce the start-up time needed for heating the apparatus and also to reduce the loss of heat energy, it is preferable to thermally insulate the heating unit from other portions and also to reduce the overall thermal capacity of the unit.

<Recording Medium with No Ink Absorptivity>

In the embodiments of the present invention, a recording medium with no ink absorptivity or low ink absorptivity (or ink nonabsorbable recording medium) can be used. The above recording medium means a recording medium or a recording medium having a surface layer (image forming layer) made of a material with no ink absorptivity or low ink absorptivity (or ink nonabsorbable material). The material with no ink absorptivity or low ink absorptivity (or ink nonabsorbable material) means, for example, resin or metal of various kinds.

<Viscosity>

The ink in the present invention is a liquid with viscosity of 10 to 500 mPa.s at 30 degree C., and preferably 40 to 500 mPa.s. If the viscosity is less than 10 mPa.s, blurredness becomes remarkable and, if it exceeds 500 mPa.s, smoothness of print is lost. The ink is preferably a liquid with viscosity of 3 to 30 mPa.s at 60 degree C., and more preferably 3 to 20 mPa.s. If the viscosity is less than 3 mPa.s, high speed jetting results in failure and, if it exceeds 30 mPa.s, jetting property deteriorates.

The entire disclosure of Japanese Patent Applications No. Tokugan 2002-349637 which was filed on Dec. 2, 2002, and No. Tokugan 2002-359316 which was filed on Dec. 11, 2002, including specification, claims, drawings and summary are incorporated herein by reference in its entirety.

What is claimed is:

1. An ink jet recording apparatus comprising:

a recording head of ink jet type for jetting ink from a plurality of jet openings;

a light source for emitting light to cure an ink jetted from the recording head and adhered to a recording medium;

a light quantity measuring section for measuring a light quantity of the light source; and a control section for controlling the light quantity of the light source according to a measured value by the light quantity measuring section.

2. The ink jet recording apparatus of claim 1, wherein the ink jet recording apparatus comprises a light source scanning section for scanning the light source above the recording medium by moving the light source in a direction perpendicular to a carrying direction of the recording medium, and a plurality of light sources disposed at different positions seen from the direction perpendicular to the carrying direction of the recording medium, the plurality of light sources being moved in order in a measuring region for the light measuring section to make the light quantity measuring section measure a light quantity of each of the plurality of light sources in order.

3. The ink jet recording apparatus of claim 2, further comprising a recording head scanning section for scanning the recording head above the recording medium by moving the recording head in the direction perpendicular to the carrying direction of the recording medium, wherein the light source scanning section is formed to move the light sources together with the ink jet head by the recording head scanning section.

4. The ink jet recording apparatus of claim 3, wherein a light quantity is measured by the light quantity measuring section every scanning.

5. The ink jet recording apparatus of claim 2, wherein a light quantity is measured by the light quantity measuring section every scanning.

6. The ink jet recording apparatus of claim 1, wherein the ink jet recording apparatus comprises a plurality of light sources and a scanning section, the scanning section moving the light quantity measuring section to measure a light quantity of each of the plurality of light sources in order by the light quantity measuring section.

7. The ink jet recording apparatus of claim 1, wherein the ink jet recording apparatus comprises a plurality of light sources at different positions seen from a carrying direction of the recording medium and a scanning section, the scanning section moving the light quantity measuring section in the carrying direction of the recording medium to measure a light quantity of each of the plurality of light sources in order by the light quantity measuring section.

8. The ink jet recording apparatus of claim 1, further comprising a recording medium supporting section for supporting the recording medium disposed between the light source and the light quantity measuring section, wherein at least a portion of the recording medium supporting section comprises a member which makes at least a portion of light of the light source pass therethrough.

9. The ink jet recording apparatus of claim 1, further comprising a storage section for storing a desired value of a light quantity controlled by the control section, and a display section for informing a measured result to a user when a measured value measured by the light quantity measuring section is less than the desired value.

10. The ink jet recording apparatus of claim 1, further comprising a storage section for storing a desired value of a light quantity controlled by the control section, wherein a recording operation by the recording head is banned when a measured value measured by the light quantity measuring section is less than the desired value.

11. The ink jet recording apparatus of claim 1, wherein a light quantity is measured by the light quantity measuring section when recording on the recording medium is started or finished.

12. The ink jet recording apparatus of claim 1, wherein a light quantity is measured by the light quantity measuring section when the ink jet recording apparatus is operating or on standby.

13. The ink jet recording apparatus of claim 1, wherein a light quantity is measured by the light quantity measuring section according to a preset operating time of the ink jet recording apparatus or an elapsed time after the ink jet recording apparatus was activated.

14. The ink jet recording apparatus of claim 1, wherein the light source is any one of a mercury lamp, a metal halide lamp, a semiconductor laser and a light emitting diode.

15. The ink jet recording apparatus of claim 1, wherein the ink is cured by an ultraviolet-ray.

16. The ink jet recording apparatus of claim 1, wherein the ink comprises a cationic polymerization ink.

17. An ink jet recording apparatus comprising:

a recording head on which a plurality of jet openings are arranged in line for jetting photo-curable ink from the jet openings on a recording medium;

a plurality of light sources for irradiating an ink jetted from the recording head with light to cure the ink;

a light quantity measuring section for measuring a light quantity of each of the plurality of light sources;

a storage section for storing a desired value of each of the plurality of light sources; and a control section for controlling the light quantity of each of the plurality of light sources according to measured values by the light quantity measuring section and desired values stored in the storage section, when a measured value of a first light source is less than a desired value of the first light source, the control section increasing a light quantity of a second light source which is different from the first light source.

18. The ink jet recording apparatus of claim 17, wherein the ink jet recording apparatus comprises a light source scanning section for scanning the light source above the recording medium by moving the light source in a direction perpendicular to a carrying direction of the recording medium, and the plurality of light sources are disposed at different positions seen from the direction perpendicular to the carrying direction of the recording medium, the plurality of light sources being moved in order in a measuring region for the light measuring section to make the light quantity measuring section measure a light quantity of each of the plurality of light sources in order.

19. The ink jet recording apparatus of claim 18, further comprising a recording head scanning section for scanning the recording head above the recording medium by moving the recording head in the direction perpendicular to the carrying direction of the recording medium, wherein the light source scanning section is formed to move the plurality of light sources together with the ink jet head by the recording head scanning section.

20. The ink jet recording apparatus of claim 19, wherein a light quantity is measured by the light quantity measuring section every scanning.

21. The ink jet recording apparatus of claim 18, wherein a light quantity is measured by the light quantity measuring section every scanning.

22. The ink jet recording apparatus of claim 17, further comprising a scanning section for moving the light quantity measuring section to measure a light quantity of each of the plurality of light sources in order by the light quantity measuring section.

23. The ink jet recording apparatus of claim 17, further comprising a scanning section, wherein the plurality of light sources are disposed at different positions seen from a carrying direction of the recording medium, and the scanning section moves the light quantity measuring section in the carrying direction of the recording medium to measure a light quantity of each of the plurality of light sources in order by the light quantity measuring section.

24. The ink jet recording apparatus of claim 17, further comprising a recording medium supporting section for supporting the recording medium disposed between the light source and the light quantity measuring section, wherein at least a portion of the recording medium supporting section comprises a member which makes at least a portion of light of the light source pass therethrough.

25. The ink jet recording apparatus of claim 17, further comprising a display section for informing a measured result to a user when a measured value measured by the light quantity measuring section is less than the desired value.

26. The ink jet recording apparatus of claim 17, wherein the control section increases a light quantity of a light source which is proximity to the first light source.

27. The ink jet recording apparatus of claim 17, wherein a light source which is proximity to the first light source irradiates a surface of the recording medium with light having a light quantity not less than a light quantity in case that the first light source irradiating with light having a desired light quantity.

28. The ink jet recording apparatus of claim 17, wherein an irradiated light quantity of a light source which is proximity to the first light source is determined according to a profile of the light source which is proximity to the first light source.

29. The ink jet recording apparatus of claim 17, wherein a recording operation by the recording head is banned when a measured value measured by the light quantity measuring section is less than the desired value.

30. The ink jet recording apparatus of claim 17, wherein a light quantity of is measured by the light quantity measuring section when recording on the recording medium is started or finished.

31. The ink jet recording apparatus of claim 17, wherein a light quantity is measured by the light quantity measuring section when the ink jet recording apparatus is operating or on standby.

32. The ink jet recording apparatus of claim 17, wherein a light quantity is measured by the light quantity measuring section according to a preset operating time of the ink jet recording apparatus or an elapsed time after the ink jet recording apparatus was activated.

33. The ink jet recording apparatus of claim 17, wherein the light source is any one of a mercury lamp, a metal halide lamp, a semiconductor laser and a light emitting diode.

34. The ink jet recording apparatus of claim 17, wherein the ink is cured by an ultraviolet-ray.

35. The ink jet recording apparatus of claim 17, wherein the ink comprises a cationic polymerization ink.

* * * * *